US008328382B2

(12) United States Patent
Crooks et al.

(10) Patent No.: US 8,328,382 B2
(45) Date of Patent: Dec. 11, 2012

(54) LUMINAIRE ROTATING FRAME CLAMPING ASSEMBLY

(75) Inventors: Brandon Crooks, New Bedford, MA (US); Mark Owen Jones, South Dartmouth, MA (US); Graham Rippel, East Walpole, MA (US); Robert Scott Gosnell, Scituate, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 326 days.

(21) Appl. No.: 12/701,129

(22) Filed: Feb. 5, 2010

(65) Prior Publication Data

US 2011/0194299 A1 Aug. 11, 2011

(51) Int. Cl.
*F21S 8/00* (2006.01)

(52) U.S. Cl. ..... 362/148

(58) Field of Classification Search ..... 362/147, 362/148, 145, 150

See application file for complete search history.

(56) References Cited

U.S. PATENT DOCUMENTS 7,832,889 B1 * 11/2010 Cogliano ..... 362/147
2010/0165607 A1 * 7/2010 Russo et al. ..... 362/147

* cited by examiner

*Primary Examiner* — Julie Shallenberger

(57) ABSTRACT

A rotatable downlight frame assembly comprises a pan having a pivot aperture therein, a collar disposed in the pan for rotating in the pivot aperture, the collar having a trim aperture wall depending through the pan, the collar having one of a square, rectangular, non-circular, or asymmetrical trim opening for positioning of a lighting trim, the collar being rotatable relative to the pan through 360 degrees, at least one fastener passing through the collar, a tool-less fastener assembly, the tool-less assembly having one of a first position and a second position for tightening the collar at an angular position relative to the pan via frictional engagement, and the other of the first position and the second position allowing for pivotable motion, and, a lighting assembly positioned on the collar for pivotal movement with the collar.

8 Claims, 8 Drawing Sheets

LUMINAIRE ROTATING FRAME CLAMPING ASSEMBLY

CROSS-REFERENCE TO RELATED DOCUMENTS

NONE

TECHNICAL FIELD

The present invention pertains to a rotating frame assembly for a luminaire. More specifically, the present invention pertains to a rotating frame clamping assembly for a recessed lighting frame end or rough end assembly.

BACKGROUND

It is often desired that square finishing sections for a recessed luminaire have some horizontal rotational capability to allow the finishing trim to be adjusted. Prior art structures currently allow for only 35-90° of horizontal rotation, defined about a vertical axis. The only known prior art device includes a frame and a trim collar which sits within a recess of a pan and includes an arcuate aperture through both the collar and the pan. A fastener is inserted through the arcuate aperture to allow the rotation through an arcuate distance of about 90°.

It would be desirable that recessed square finishing sections in a recessed luminaire have rotational capabilities up to at least 360°. It is also desirable that the finishing trim be adjustable with respect to walls or other finishing sections to optimize the layout of the group of luminaries. It is also desirable that the rotational adjustment of be of the tool-less variety and up to 360°.

SUMMARY

A rotatable downlight frame assembly comprises a pan having a pivot aperture therein, a collar disposed in the pan for rotating in the pivot aperture, the collar having a trim aperture wall depending through the pan, the collar having one of a square, rectangular, non-circular, or asymmetrical trim opening for positioning of a lighting trim, the collar being rotatable relative to the pan through 360 degrees, at least one fastener passing through the collar, a tool-less fastener assembly, the tool-less assembly having one of a first position and a second position for tightening the collar at an angular position relative to the pan via frictional engagement, and the other of the first position and the second position allowing for pivotable motion, and, a lighting assembly positioned on the collar for pivotal movement with the collar. The rotatable downlight frame assembly wherein the pan and the collar further comprise a brake connected to the collar and rotatable engaging the pan. The rotatable downlight frame assembly wherein the collar has an outer diameter which is larger than a diameter of the pivot aperture. The rotatable downlight frame assembly wherein the brake depends from one of a lower surface or an upper surface of the collar and defining a space or groove between the brake shoe and the collar. The rotatable downlight frame assembly wherein an edge of the pivot aperture is disposed within the space between the brake shoe and the collar. The rotatable downlight frame assembly wherein the at least one fastener passes through the brake and the collar. The rotatable downlight frame assembly further comprising a brake connected to the pan and the collar disposed between the brake and the pan. The rotatable downlight frame assembly further comprising biasing elements on the collar. The rotatable downlight frame assembly further comprising opposed hanger bars connected to the pan. The rotatable downlight frame assembly wherein the pivot aperture is defined by a horizontal groove. The rotatable downlight frame assembly wherein the collar is disposed within the horizontal groove. The rotatable downlight frame assembly wherein the groove defined by an upper surface and a lower surface which frictionally engage the collar in one of a first position or a second position.

A rotatable downlight frame assembly comprises one of a square, rectangular, or other non-circular shaped trim aperture positioned within a collar, a trim aperture wall depending downwardly from the collar, a pan receiving the collar within a pivot aperture, the collar rotatable about a vertical axis within the pan, a fastener assembly including a fastener and tightening device, wherein the tightening device tightens one of the pan and the collar against the other of the pan and the collar, the fastener assembly having a first position wherein the pan is rotatable about the vertical axis through a distance of 360 degrees, the fastener assembly having a second position wherein the pan is locked in an angular position. The rotatable trim frame assembly further comprising a brake extending from one of the pan and the collar. The rotatable trim frame assembly wherein the fastener assembly passes through the brake to tighten the other of the pan and the collar. The rotatable trim frame assembly wherein the trim aperture is asymmetrical.

A rotatable trim frame assembly, comprises a pan having a substantially circular opening, the substantially circular opening, a collar seated within the horizontal groove, the collar having one of a square, rectangular or other non-circular opening therein, and a brake connected to said collar and defining a horizontal groove, an edge defining said opening of the pan disposed within the horizontal groove, a trim assembly and a lighting assembly positioned in the one of a square, rectangular or substantially circular opening, at least one hangar bar connected to the pan, a fastener assembly extending through the pan and the collar, the fastener assembly having a first position wherein the collar is rotatable within the pan, and a second position wherein the collar is locked relative to the pan.

BRIEF DESCRIPTION OF THE ILLUSTRATIONS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
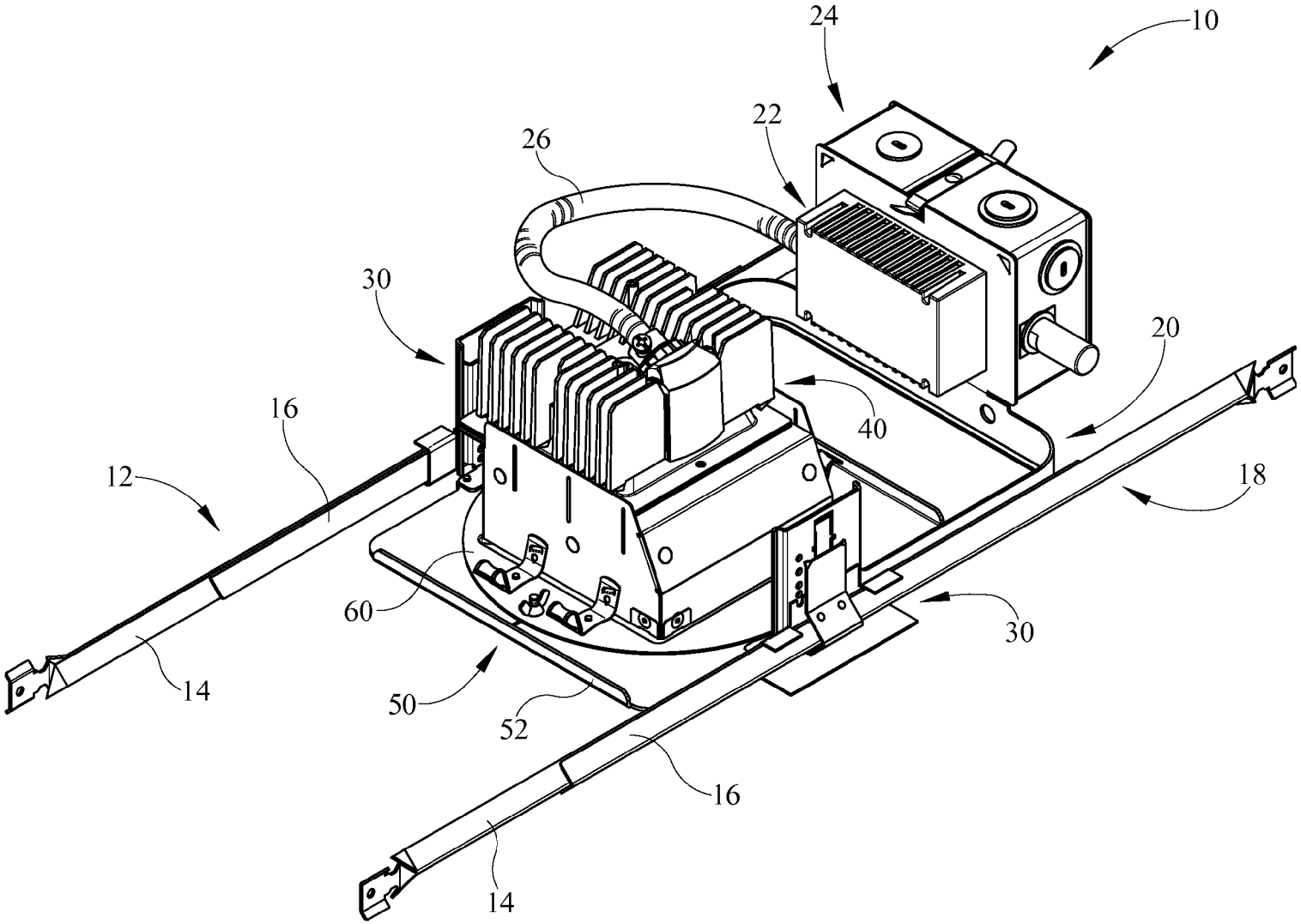
FIG. 1 depicts a perspective view of the rotating frame clamping assembly for a recessed luminaire.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

A rotating frame clamping assembly for a recess luminaire is depicted in FIG. 1-8. The assembly utilizes a pan and collar assembly to provide 360° (degrees) of rotation for a square, rectangular, non circular or other asymmetrically shaped finishing trim. The assembly utilizes tool-less fasteners to provide engagement between a brake assembly, the pan and a collar and thus allow or inhibit rotation.

Figure 2:
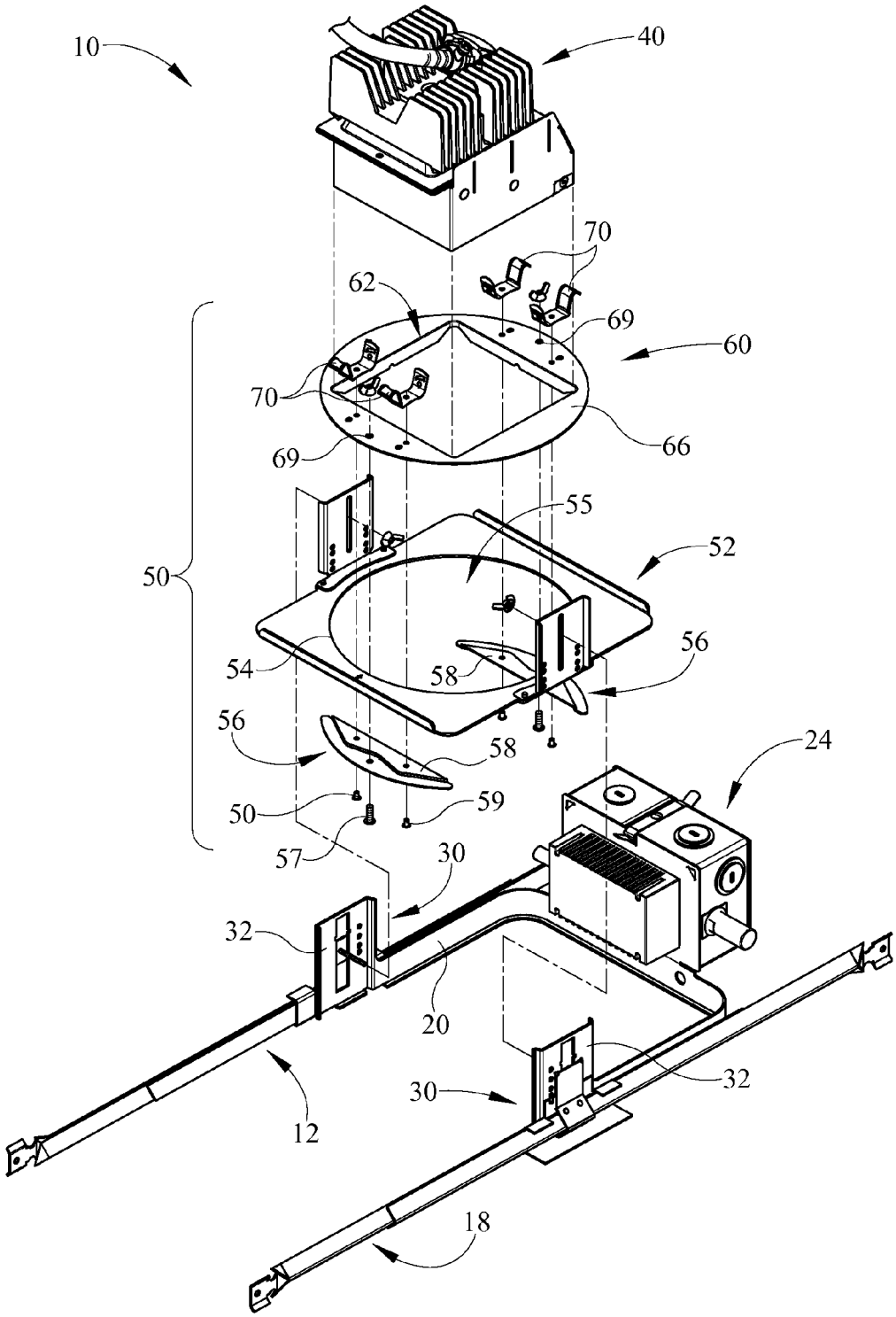
FIG. 2 depicts an exploded perspective view of the assembly of FIG. 1.
Figure 3:
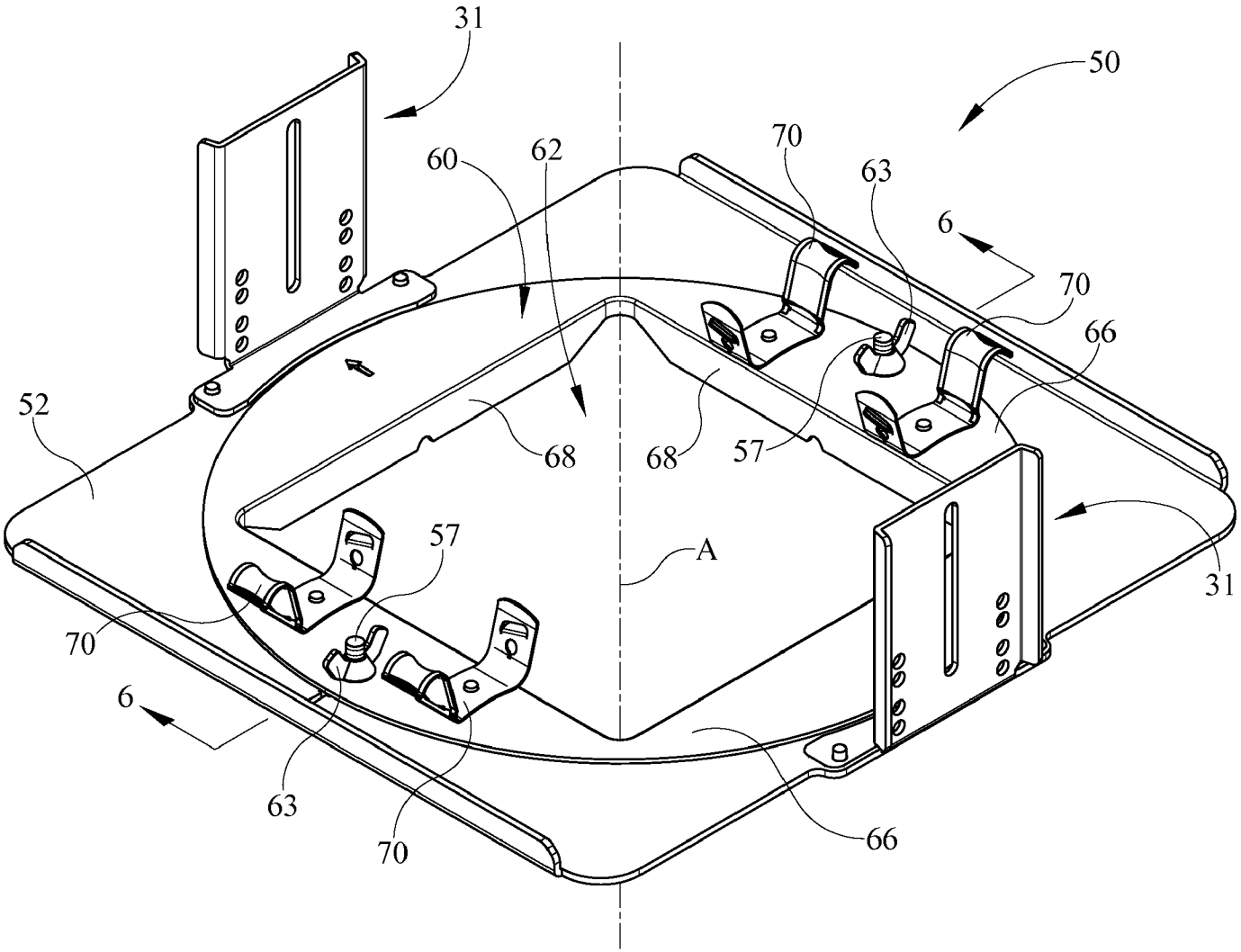
FIG. 3 depicts an upper perspective view of the rotating assembly.

Referring initially to FIG. 1, a rotating frame clamping assembly for a recessed rough-in kit 10 is depicted. The kit 10 includes a first hanger bar 12, comprising a first slidable portion 14 and a second slidable portion 16 as well as an opposed hanger bar 18 also defined by a first slidable portion 14 and a second slide portion 16. The hanger bars 12, 18 may be connected to a ceiling grid system or between joists of a ceiling. Each of the hanger bars 18 is connected to a recessed lighting frame 20 by a height adjustment assembly 30 having mounting brackets 32 and adjacent slides 31 (FIGS. 2 and 3). The frame 20 is generally U-shaped having and open end and a closed end. Although the frame 20 is shown in the figures are U-shaped, various shapes may be utilized. Additionally, the frame 20 may be integrally formed with or fastened to a pan 52. The frame 20 further comprises the height adjustment assemblies 30 at the open ends which receive the first and second hanger bars 12, 18. Thus the hanger bars 12, 18 and the frame number 20 may be adjusted relative to one another to provide adjustment of the hanger bars 12, 18 relative to the frame and finishing trim or lighting kit 40. Connected to the U-shaped frame 20 at the closed end are a power supply 22 and a junction box 24. A conduit 26 extends between power supply 22 and the finishing trim 40 to provide power to a plurality of luminaires therein. Additionally, according to the exemplary embodiment, the power supply 22 is connected to a side wall of the junction box to provide electrical communication there between without the requirement of an additional junction box or connector assembly. Within the conduit 26 is at least two wires for powering the lights within a finishing trim 40. These elements will be understood by one skilled in the art and therefore are not discussed in greater detail.

The recessed rough-in kit 10 further comprises a rotating assembly 50 which allows rotation of the finishing trim 40 through about 360°. The rotating assembly 50 is tool-lessly operable allowing for easy adjustment of the finishing trim with respect to walls and other finishing trims in a lighting layout. The rotating assembly 50 is disposed between the open ends of the U-shaped frame 20 and may be integrally formed with the frame 20 or may be fastened thereto.

Referring now to FIG. 2, an exploded perspective view of the recessed rough end kit 10 is depicted at the bottom of the figure, the hanger bars 12, 18 are shown connected to the frame 20 by a height adjustment assembly 30. Additional information on the height adjustment mechanism and hanger bars may be found and is hereby incorporated by reference from U.S. patent application Ser. No. 11/135,562, now issued as U.S. Pat. No. 7,234,674. Above the hanger bars 12 and frame 20 is the rotation assembly 50. The rotation assembly 50 comprises a pan 52, having a circular aperture 55 defined by an aperture wall 54. The pan 52 is generally square shaped, although such shape should not be considered limiting, and further comprises vertically extending slides 31 (FIG. 3). The slides 31 are part of a vertical adjustment assembly 30 allowing vertical adjustment of the rotating assembly 50 relative to the hanger bars 12, 18. The pan 52 is sandwiched or captured between a brake assembly 56 and a collar 60. The brake assembly 56 includes at least one brake. As shown in the instant embodiment the at least one brake is defined by two brake pads at opposite sides of the circular aperture 54 and which are mounted to the bottom surface of the pan 52. The brakes are semi-circular and have a raised portion 58 which fits within the aperture wall 54. The brakes 56 are connected to the pan 52 by fasteners, such as threaded bolts, screws, rivets or the like extending through the brakes 56, through the pan aperture 55 and through the collar 60.

The collar 60 is circular in shape and comprises a trim aperture 62 which may be square, rectangular, or any asymmetrical shape. The collar 60 has an upper surface 66, a lower surface 67 and a plurality of depending aperture walls or flange 68. The collar 60 further comprises a plurality of fastening apertures 69 which receive the at least one fastener 57 from the brake 56 and through an aperture 55. Disposed on the upper surface of the collar 60 are a plurality of biasing elements 70. The elements 70 are connected to the brakes 56 by fasteners 59 which also extend through the pan aperture 55. The spring elements 70 engage the side wall of the trim or lighting kit 40 to retain the trim within the collar 60, as best seen in FIG. 1. Thus when the collar 60 rotates, the trim kit 40 also rotates. Alternatively, the walls 68 may be visually indicative of alignment or the requirement for additional adjustment.

Referring now to FIG. 3, the rotation assembly 50 is shown in perspective view in an assembled condition with the lighting assembly or trim kit 40 removed. A rotational axis A extends vertically through the pan aperture 62. The collar 60 rotates horizontally about this vertical axis A within the pan 52. In this view, the collar 60 has an outer diameter which is greater than the diameter of the pan aperture 55 (FIG. 2). Additionally, the brakes 56 are spaced apart such that the outer-most curved edges of the brakes 56 are spaced apart at a distance greater than the diameter of the pan aperture 55. A fastener assembly includes the fasteners 57 and the wing nuts 63. The fasteners connect the brakes 56 to the collar 54 and capture the pan 52 there between. When the fasteners 57 are loosened, the collar 60 and the at least one brake 56 rotate while the pan 52 is stationary with the frame 20 (FIG. 2). However, when the fastener assemblies are tightened, the collar and the brakes 60, 56 clamp down on the pan 52 inhibiting rotation of the collar 60 and at least one brake 56 relative to the pan 52. This rotation is said to be tool-less since the fastener assemblies utilize hand-tightenable wing nuts 63.

Figure 4:
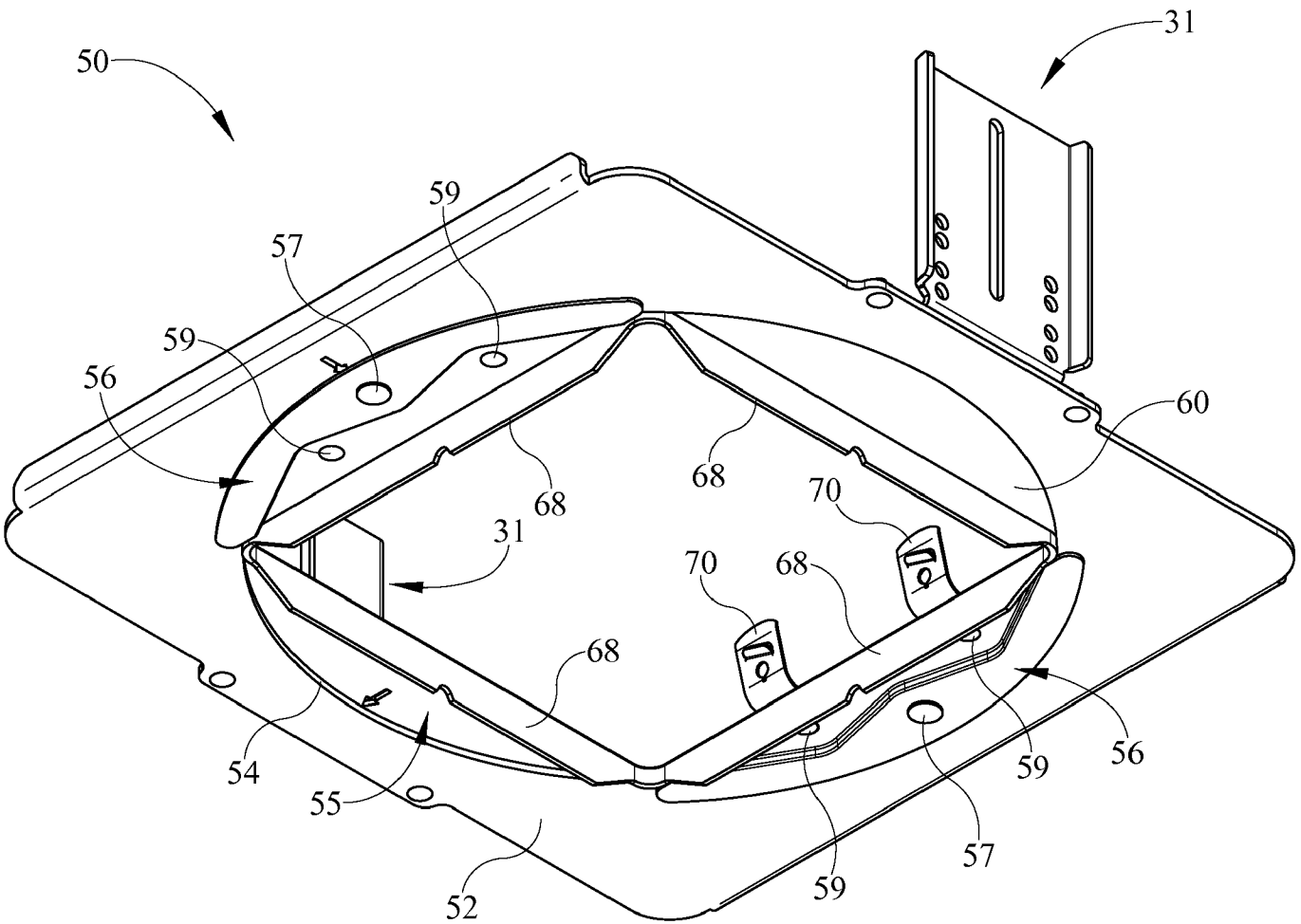
FIG. 4 depicts a bottom perspective view of the rotating assembly of FIG. 3.

Referring now to FIG. 4, a lower perspective view of a rotating assembly 50 is depicted. The collar 60 is shown in a position above the pan 52 and the trim walls 68 are depending downwardly through the pan aperture 55 defined by pan aperture wall 54. Also depicted, the brakes 56 have regularly outward opposed curved edges which have a spaced apart distance greater than the diameter of the pan aperture wall 54. Thus the collar 60 extends beyond the pan aperture wall on the upper surface of the pan and the brakes 56 extend outward beyond the curved pan aperture wall on the bottom surface of the fan. This captures the pan 52 between the collar and brakes 56 so that the assembly stays connected and cannot move.

Figure 5:
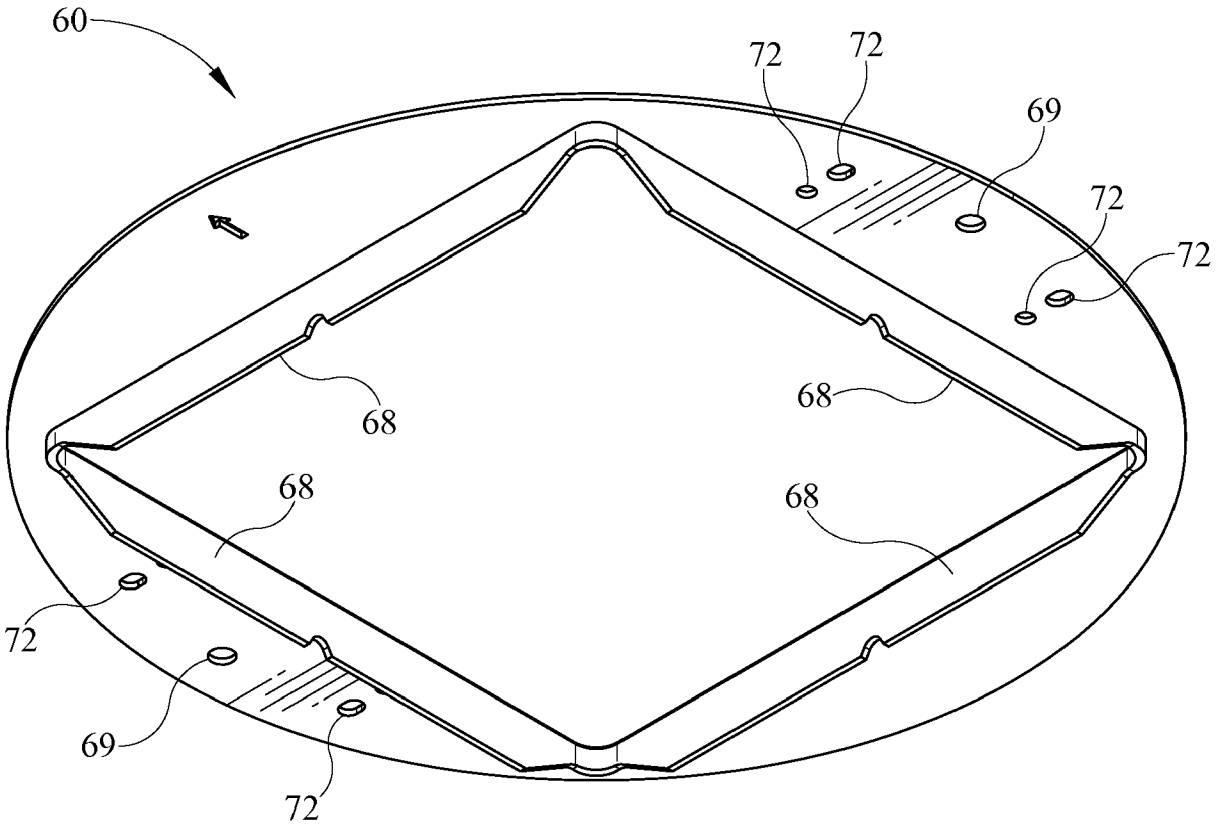
FIG. 5 depicts a bottom perspective view of the collar.

Referring now to FIG. 5, the collar is shown removed from the rotation assembly. The collar 60 is circular in shape as previously described. The walls 68 depend downwardly to receive a trim or lighting assembly 40 (FIG. 2). The collar 60 also comprises a plurality of apertures 72 which provide for receipt of spring fasteners 59 to retain the biasing elements 70 on the upper surface of the collar 60. The collar also comprises opposed fastening apertures 69 which receive tightening fasteners 57 to retain the brakes 56 on the bottom surface of the collar and the collar 60 within the aperture 55 of the pan 52. The trim aperture walls 68 have a perimeter dimension sized to fit within the circumference of the pan aperture wall 54. The walls 68 may engage the aperture wall 54 or may be slightly inset from the aperture wall 54. In either event, the distance between the aperture wall 54 and the trim wall 68 is minimal to inhibit play or slack between the two parts. The trim aperture walls 68 also provide a visual reference for determining whether a plurality of light fixtures are aligned prior to installation of drywall. The walls 68 each have a notch which may be utilized in combination with string or laser to ensure alignment over the length of, for example, a hallway. Since the walls 68 depend from the collar 60, the walls 68 ease in visual identification of any misaligned trims prior to installation of ceiling material. This arrangement also allows for movement of the trim once the prior to installation of the ceiling material, which abuts outer surfaces of the walls 68.

Figure 6:
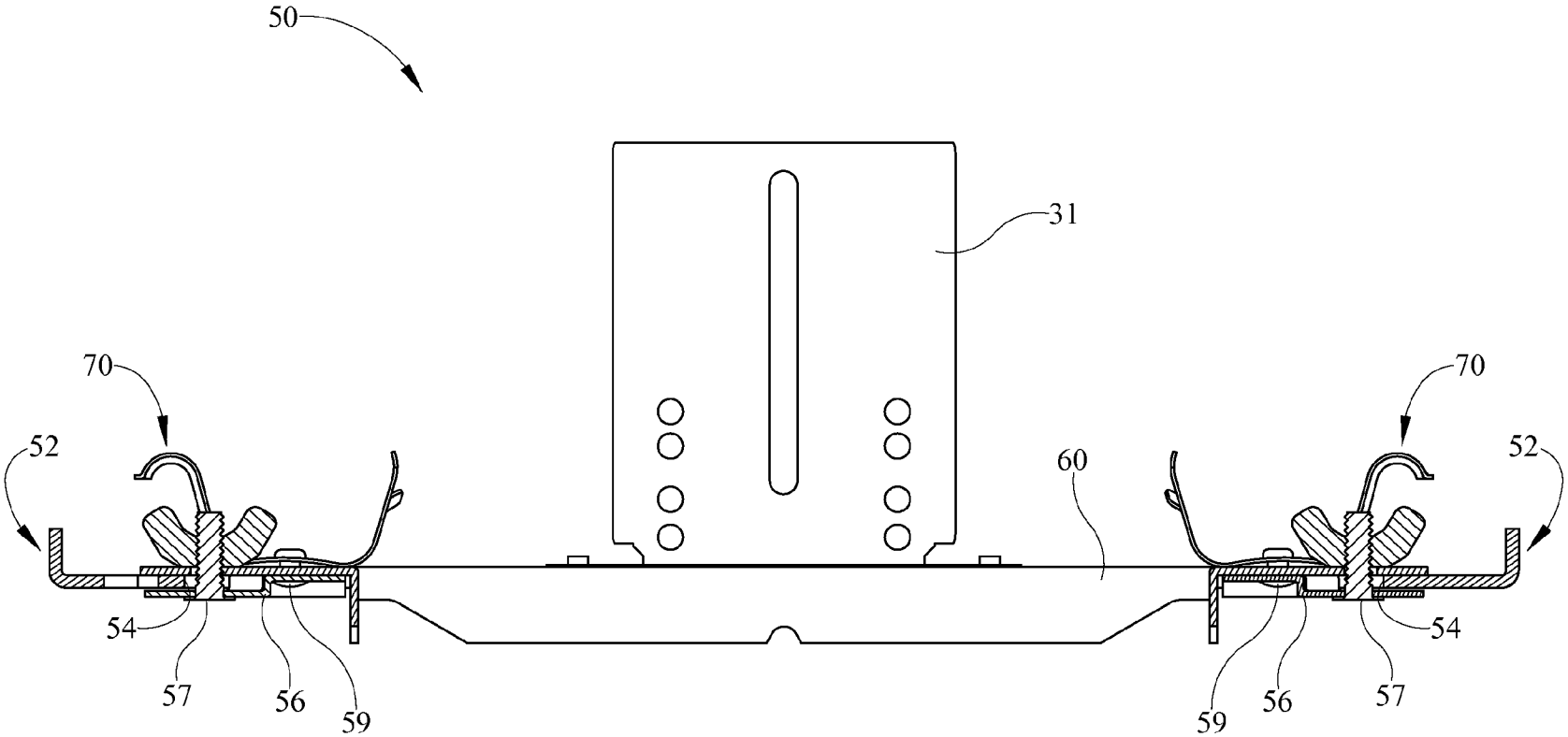
FIG. 6 depicts a side section view as indicated in FIG. 3.

Referring now to FIG. 6, a side section view of the rotating assembly 50 is depicted. The pan 52 is shown sandwiched or captured between the collar 60 and the brake portions 56. As shown in the figure, a space or groove is formed between the collar 60 and the brake 56 wherein the pan 52 is received. The collar 50 and brakes 56 can rotate relative to the stationary pan 52. The fastener 57 extends upwardly from the brake through the collar 60. By tightening the wing nut 63, the collar 60 and the brake 56 clamp the pan to inhibit rotation of the collar and the brake 56. Conversely, when the wing nut 63 is loosened, the collar and brake 60, 56 may rotate relative to the fixed pan 52, hanger bars 12, 18 and frame 20. With this rotation, the trim kit 40 (FIG. 1) may also rotate. As opposed to the prior art devices, the fixture rotation is not limited to 90° but may rotate up to 360°.

Figure 7:
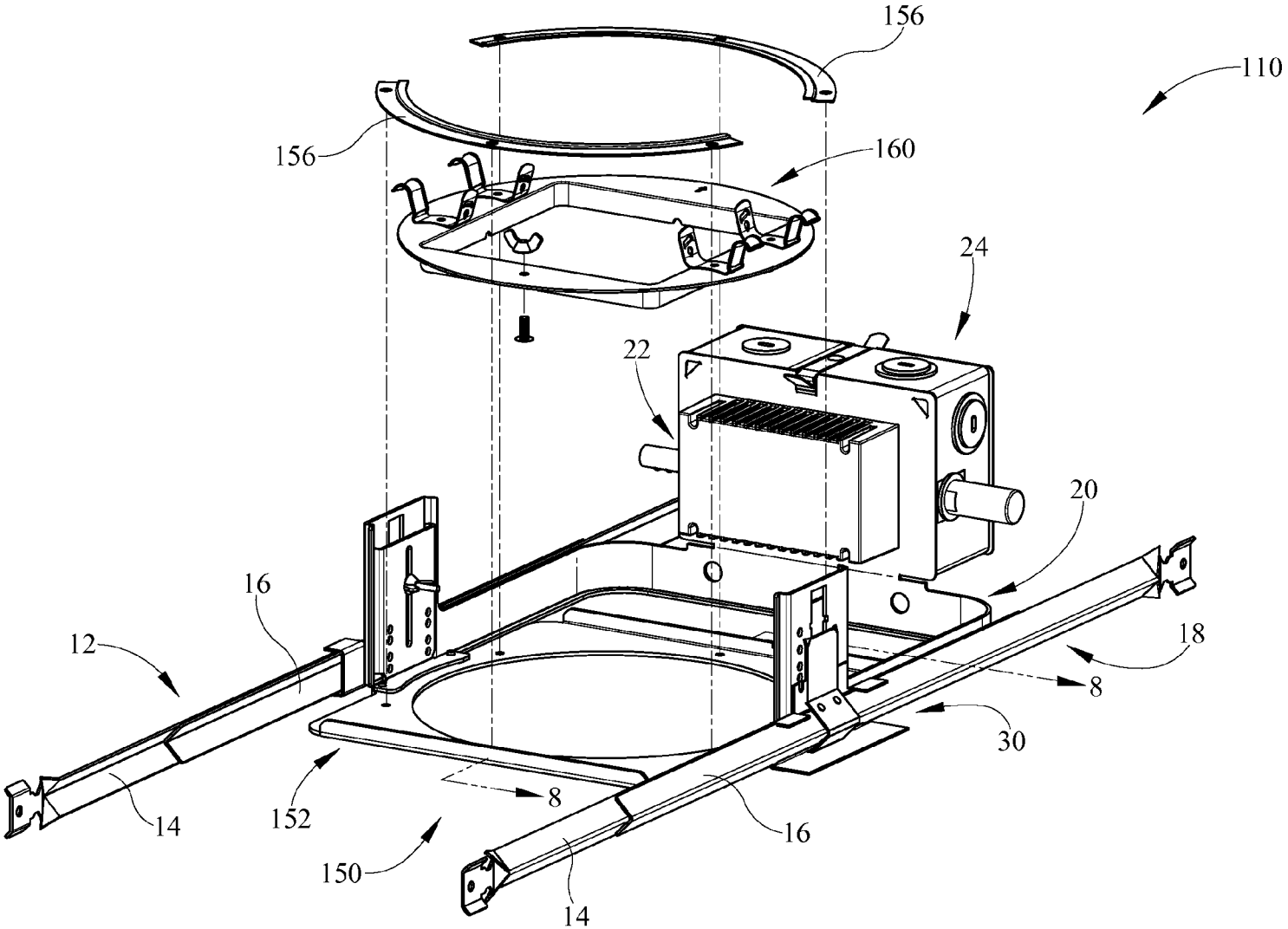
FIG. 7 depicts an exploded perspective view of an alternative embodiment; and, FIG. 8 depicts a sectional view of the alternative embodiment of FIG. 7.

Referring now to FIG. 7, an exploded perspective view of the rotating frame clamping assembly 110 is depicted. The exploded perspective view shows how the rotational assembly 150 differs from the first embodiment. According to the first embodiment, the collar 60 and brakes 56 rotate relative to the pan 52 (FIG. 1) since the collar 60 and brakes 56 capture the pan 52. Alternatively, according to the embodiment shown in FIGS. 7 and 8, the collar 160 rotates relative to a stationary pan 152 and a stationary brake 156 since the collar 160 is captured between the pan 152 and the brakes 156.

Figure 8:
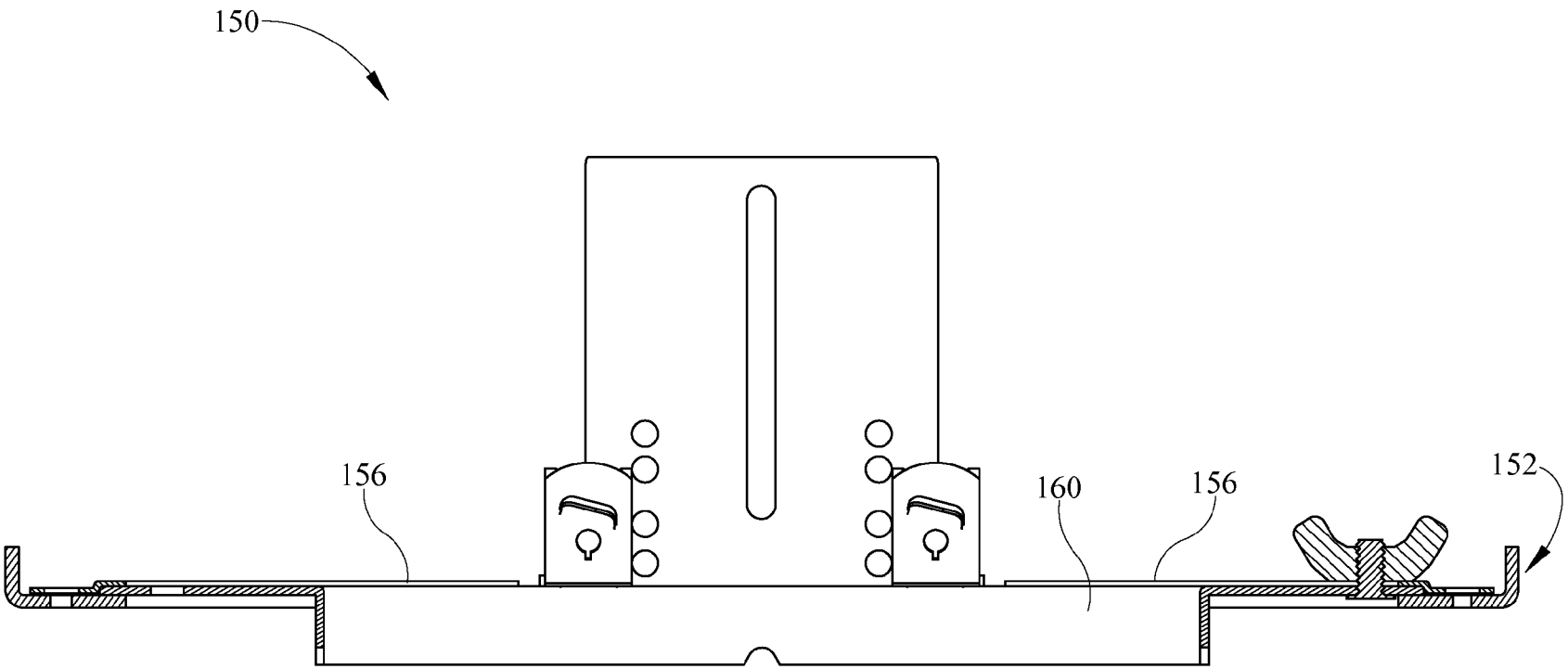

As shown in FIG. 8, the cross-sectional view depicts how the wing nut 172 may be tightened to clamp the collar with the brakes 156 and the pan 152. According to this embodiment, a horizontal groove is created between the brakes 156 and the pan 152, wherein the collar 160 is rotatably positioned. With the collar 160 positioned therein the collar 160 may rotate or may be fixed depending on a position of the fastener assembly, including fastener 157 and wing nut 172.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A rotatable downlight frame assembly, comprising:

a pan having a pivot aperture therein;

a collar disposed in said pan for rotating in said pivot aperture, said collar having a trim aperture wall depending through said pan and said collar having an outer diameter which is larger than a diameter of said pivot aperture;

said collar having one of a square, rectangular, non-circular, or asymmetrical trim opening for positioning of a lighting trim;

said collar being rotatable relative to said pan through 360 degrees;

at least one fastener passing through said collar;

a tool-less fastener assembly, said tool-less assembly having one of a first position and a second position for tightening said collar at an angular position relative to said pan via frictional engagement, and the other of said first position and said second position allowing for pivotable motion; and, a lighting assembly positioned on said collar for pivotal movement with said collar:

wherein said pan and said collar further comprising a brake connected to said collar and rotatable engaging said pan; said brake depending from one of a lower surface or an upper surface of said collar and defining a space between said brake and said collar.

2. The rotatable downlight frame assembly of claim 1 wherein an edge of said pivot aperture is disposed within said space between said brake and said collar.

3. The rotatable downlight frame assembly of claim 1, said at least one fastener passing through said brake and said collar.

4. A rotatable downlight light frame assembly, comprising:

a pan having a pivot aperture therein;

a collar disposed in said pan for rotating in said pivot aperture, said collar having a trim aperture wall depending through said pan;

said collar having one of a square, rectangular, non-circular, or asymmetrical trim opening for positioning of a lighting trim;

said collar being rotatable relative to said pan through 360 degrees;

at least one fastener passing through said collar;

a tool-less fastener assembly, said tool-less assembly having one of a first position and a second position for tightening said collar at an angular position relative to said pan via frictional engagement, and the other of said first position and said second position allowing for pivotable motion;

a lighting assembly positioned on said collar for pivotal movement with said collar; and, a brake connected to said pan wherein said collar is disposed between said brake and said pan.

5. The rotatable downlight frame assembly of claim 1 further comprising biasing elements on said collar.

6. The rotatable downlight frame assembly of claim 1 further comprising opposed hanger bars connected to said pan.

7. The rotatable downlight frame assembly, comprising:

a pan having a pivot aperture therein;

a collar disposed in said pan for rotating in said pivot aperture, said collar having a trim aperture wall depending through said pan;

said collar having one of a square, rectangular, non-circular, or asymmetrical trim opening for positioning of a lighting trim;

said collar being rotatable relative to said pan through 360 degrees;

at least one fastener passing through said collar;

a tool-less fastener assembly, said tool-less assembly having one of a first position and a second position for tightening said collar at an angular position relative to said pan via frictional engagement, and the other of said first position and said second position allowing for pivotable motion; and, a lighting assembly positioned on said collar for pivotal movement with said collar:

wherein said pan and said collar further comprising a brake connected to said collar and rotatable engaging said pan, said brake depending from one of a lower surface or an upper surface of said collar and defining a groove between said brake and said collar.

8. The rotatable downlight frame assembly of claim 4 further comprising biasing elements on said collar.

* * * * *